US009200228B2

(12) United States Patent
Boudreau

(10) Patent No.: US 9,200,228 B2
(45) Date of Patent: Dec. 1, 2015

(54) LUBRICANT COMPOSITIONS CONTAINING LINDQVIST METALATES

(71) Applicant: VANDERBILT CHEMICALS, LLC, Norwalk, CT (US)

(72) Inventor: David M. Boudreau, Ansonia, CT (US)

(73) Assignee: VANDERBILT CHEMICALS, LLC, Norwalk, CT (US)

( * ) Notice: Subject to any disclaimer, the term of this patent is extended or adjusted under 35 U.S.C. 154(b) by 94 days.

(21) Appl. No.: 14/107,393

(22) Filed: Dec. 16, 2013

(65) Prior Publication Data

US 2014/0179575 A1 Jun. 26, 2014

Related U.S. Application Data

(60) Provisional application No. 61/740,151, filed on Dec. 20, 2012.

(51) Int. Cl.

| | |
|---|---|
| ***C10M 125/00*** | (2006.01) |
| ***C10M 125/22*** | (2006.01) |
| ***C10M 133/04*** | (2006.01) |

(52) U.S. Cl.

CPC ..... *C10M 133/04* (2013.01)

(58) Field of Classification Search

CPC ..... C10M 133/04
USPC ..... 508/300, 362
See application file for complete search history.

(56) References Cited

U.S. PATENT DOCUMENTS

2013/0206646 A1* 8/2013 Neumann et al. ..... 208/243

FOREIGN PATENT DOCUMENTS

CN 102304152 A * 1/2012
WO WO 2012059914 A1 * 5/2012

OTHER PUBLICATIONS

EIC/STIC Search Jan. 23, 2015.*

* cited by examiner

*Primary Examiner* — Pamela H Weiss
(74) *Attorney, Agent, or Firm* — Norris McLaughlin & Marcus P.A.

(57) ABSTRACT

A lubricating composition comprises a major amount of a base oil, and an additive comprising a polyoxo Lindqvist ion of formula $[M1_aM2_bQ1_cQ2_d]^q$, wherein M1 and M2 may be the same or different and are chosen from Group 3-12 transition metals, the Lindqvist ion being solvated with a hydrocarbyl substituted amine, the Lindqvist ion optionally containing bound organic ligands containing electron donating groups, the additive being present in amount to provide about 0.2-3 moles of metal from the Lindqvist ion per megagram of lubricating composition.

17 Claims, No Drawings

LUBRICANT COMPOSITIONS CONTAINING LINDQVIST METALATES

BACKGROUND OF THE INVENTION

A lubricating additive composition and lubricating composition for lubricating surface providing a method for reducing wear and improving antioxidancy wherein the lubricating composition contains a base oil of lubricating viscosity and a sufficient amount of hydrocarbon soluble Lindqvist polyoxometalate which effectively provides a greater reduction in surface wear or lubricant antioxidancy relative to the lubricant composition deficient of the Lindqvist polyoxometalate.

FIELD OF THE INVENTION

This invention generally relates to hydrocarbon soluble Lindqvist ions and their use in lubricating composition to reduce wear or increase antioxidancy in a lubricating composition.

BACKGROUND

Engine technology requires ever improving performance and the need to reduce wear friction and oxidation at minimal cost. In an effort to meet this need, it has been discovered that a class of polyoxometalate ions arranged in a Lindqvist structure may be used in a lubricating composition to help reduce the deleterious effects on engine components during operation.

Polyoxometalate ions have been known since the discovery of the phosphomolybdate ion $[PMo_{12}O_{40}]^{3-}$, by J. Berzelius in 1826 [Pope, 1983]. Since that time many polyoxometalates have been discovered and fall into several classes of composition based upon size and structure of the polyatomic ion. Of particular interest is the Lindqvist structure, first identified by I. Lindqvist [Lindqvist, 1952]. Lindqvist structures possess the highest level of symmetry of all the various polyoxometalate structures. Polyoxometalates of this structural composition consist of six edge and corner sharing octahedra wherein each octahedron contains a central transition metal atom coordinated to six chalcogens. The six octahedra are arranged in a manner to give the Lindqvist ion an octahedrally-coordinated central chalcogen atom surrounded by six metal atoms, and an overall octahedral geometry.

DESCRIPTION OF THE INVENTION

In one embodiment of this invention, a hydrocarbon soluble Lindqvist polyoxometalate ion is used as a lubricant additive composition. This additive composition may further be added to a lubricant containing a major amount (>=50% by weight, preferably >80% by weight) of base oil of lubricating viscosity. The additive may be used in addition to, or as a partial or total replacement of additives contains sulfur and phosphorus.

The polyoxo Lindqvist ion has a core structure comprised of six edge sharing octahedra. Each octahedron contains a central atom represented by a D-Block element from Group 3-12 in the Periodic Table. Each octahedron is comprised of one terminal atom comprised of B, C, N, O, P or S. Each octahedron is comprised of four $\mu_2$-bridging atoms to the adjacent metal centers and are commonly, but not limited to O, or S. The six octahedra in combination give the Lindqvist ion an overall octahedral symmetry. The general formula is $[M1_aM2_bQ1_cQ2_d]^q$, wherein M1 and M2 are Group 3-12 transition metals, and a+b=6. Q1 is a terminal atom, or ligand.

Q2 is a bridging atom, and c+d=19. The charge q is highly dependent on the selection of M1 and M2 as well as the overall oxidation state of the polyoxo Lindqvist ion, and is commonly in the range of −1 to −12, but is not specifically limited to this range.

In one embodiment of this invention, the Lindqvist ion is an isopolyoxometalate, wherein M1=M2, and may be selected from transition metals from Group 4-6 and include the elements of Ti, Zr, Hf, V, Nb, Ta, Cr, Mo, or W.

In a preferred embodiment of this invention, the Lindqvist ion is a heteropolymetalate and has a mixed transition metal composition, wherein M1 is not equal to M2, and a<b. The major metal (M2) may be selected from transition metals from Group 4-6 and include the elements of Ti, Zr, Hf, V, Nb, Ta, Cr, Mo, or W. In a more preferred embodiment, M2=Mo or W. In a most preferred embodiment, M2=W. The minor metal component (M1) is a D-Block element from Group 3-12 and may also include the transition metals of Groups 4-6. Some possible, though non-limiting, combinations of M1 and M2 in a mixed transition metal Lindqvist ion may be Zr/Mo, Zr/W, Ti/W, Mo/W, V/W, V/Mo, Nb/Mo, Nb/W, Ta/Mo, Ta/W and Ti/Mo.

Depending on the nature of the Lindqvist ion, Q1 may also be comprised of organic ligands containing electron donating groups comprised of B, C, N, O, P or S, and the ligands are bound to the Lindqvist ion through those groups. Non-limiting examples of Lindqvist ions containing bound organic ligands are $(C_3H_6O)TiW_5O_{18}^{3-}$, $CH_3ZrW_5O_{18}^{2-}$, and $ArNMo_6O_{18}^{2-}$, where Ar is an aromatic ring as defined in U.S. Pat. No. 6,664,408, incorporated herein by reference in its entirety.

The Lindqvist anion may be added to a lubricant composition in the form of a neutral salt, by combining it with cations of elements in Groups 1-12. Preferred, but non-limiting examples are cations of H, Li, Na, Mg, Al, K, Ca, Ti, Mn, Fe, Cu, Zn, Zr, Cs, and Ba.

To substantially increase the hydrocarbon lubricant solubility of the Lindqvist ions, they may be combined with cations of a first hydrocarbyl substituted amine. An additional amount of non-protonated second hydrocarbyl substituted amines may be added to the Lindqvist ion salt as further solvating agents to the Lindqvist ion. The second amine may be the same or different than the cationic first amine used to form the Lindqvist ion salt The molar ratio of nitrogen, totaling from the cationic first hydrocarbyl substituted amines and the second hydrocarbyl substituted amines, to the molar metal content in the Lindqvist ion, N:(M1+M2), will range from 1/3:1, to 6:1. It would be understood that an even greater ratio than 6:1 of N:(M1+M2) is possible, but would be relatively undesirable due to the cost of using such a large excess of amine A preferred ratio of amine to metal is 1.2:1 to 1:3/4.

First and second hydrocarbyl substituted amines used for the solvation of the Lindqvist ions of this invention include monoamines of the general formula:

Formula I

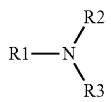

wherein the monoamine may also be a primary amine wherein R2 and R3 are hydrogen, and R1 represents linear, branched, saturated or unsaturated alkyl of 1 to 40 carbon atoms that may optionally contain at least one ether moiety, cycloalkyl of 5 to 40 carbon atoms, aryl of 6 to 40 carbon atoms, or aralkyl of 7 to 9 carbon atoms, where the aralkyl is substituted further by alkyl of 1 to 36 carbon atoms. R1 may optionally contain alkylesters, where the alkyl is of 1 to 36 carbon and may also be a derivative of coca, castor, coconut, corn, cottonseed, linseed, olive, palm, palm olein, palm stearin, palm kernel, peanut, canola, rapeseed, safflower, sesame, sunflower, soybean, tall, tung, or tallow oils. R1 may optionally contain an alkylamide, where the alkyl is of 1 to 36 carbon and may also be a derivative of coca, castor, coconut, corn, cottonseed, linseed, olive, palm, palm olein, palm stearin, palm kernel, peanut, canola, rapeseed, safflower, sesame, sunflower, soybean, tall, tung, or tallow oils. Non-limiting examples of primary amines useful to this invention are methylamine, isopropylamine, 2-aminoethanol, 3-isopropoxypropylamine, 2-ethylhexyloxypropylamine, Armeen® C (available from Akzo Nobel), Primene™ JIM-T and Primene™ 81-R (available from Rohm & Hass), (Z)—N-(2-Aminoethyl)-cocoamide), N-(2-hydroxyethyl(Z)—N-(2-Aminoethyl)-cocoamide), (Z)—N-(2-Aminoethyl)-canolamide), N-(2-hydroxyethyl(Z)—N-(2-Aminoethyl)-canolamide, (Z)—N-(2-Aminopropyl)-cocoamide,)

The monoamine may also be a secondary amine, wherein R3 is hydrogen and R1 and R2 independently represent linear, branched, saturated or unsaturated alkyl of 1 to 40 carbon atoms that may optionally contain at least one ether moiety, cycloalkyl of 5 to 40 carbon atoms, aryl of 6 to 40 carbon atoms, or aralkyl of 7 to 9 carbon atoms, where the aralkyl is substituted further by alkyl of 1 to 36 carbon atoms. R1 and R2 may optionally contain alkylesters, where the alkyl is of 1 to 36 carbon and may also be a derivative of coca, castor, coconut, corn, cottonseed, linseed, olive, palm, palm olein, palm stearin, palm kernel, peanut, canola, rapeseed, safflower, sesame, sunflower, soybean, tall, tung, or tallow oils. R1 and R2 may optionally contain an alkylamide, where the alkyl is of 1 to 36 carbon and may also be a derivative of coca, castor, coconut, corn, cottonseed, linseed, olive, palm, palm olein, palm stearin, palm kernel, peanut, canola, rapeseed, safflower, sesame, sunflower, soybean, tall, tung, or tallow oils.

The monoamine may be a tertiary amine, wherein R1, R2, and R3 independently represent a C1 to C36 residue that may optionally contain at least one ether moiety, cycloalkyl of 5 to 12 carbon atoms, or aralkyl of 7 to 9 carbon atoms, where the aralkyl is further substituted by alkyl of 1 to 36 carbon atoms. R1, R2 and R3 may optionally contain alkylesters, where the alkyl is of 1 to 36 carbon and may also be a derivative of coca, castor, coconut, corn, cottonseed, linseed, olive, palm, palm olein, palm stearin, palm kernel, peanut, canola, rapeseed, safflower, sesame, sunflower, soybean, tall, tung, or tallow oils. R1, R2 and R3 may optionally contain an alkylamide, where the alkyl is of 1 to 36 carbon and may also be a derivative of coca, castor, coconut, corn, cottonseed, linseed, olive, palm, palm olein, palm stearin, palm kernel, peanut, canola, rapeseed, safflower, sesame, sunflower, soybean, tall, tung, or tallow oils.

In addition, the first hydrocarbyl substituted amines may be a quaternary amine of the formula:

Formula II

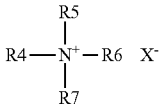

wherein R4, R5, R6 and R7 are independently each a C1 to C36 residue that may optionally contain at least one ether moiety, cycloalkyl of 5 to 12 carbon atoms, or aralkyl of 7 to 9 carbon atoms, where the aralkyl is further substituted by alkyl of 1 to 36 carbon atoms. X represents a counter ion and may most commonly be chosen from the group of hydroxide, sulfide, sulfate, hydrogensulfate, fluoride, chloride, bromide or iodide.

First and second hydrocarbyl substituted amines used for the solvation of the Lindqvist ions of this invention may include a diamine of the general formula:

Formula III

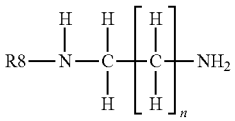

wherein n is 1 to 5 and preferably 1 or 2, and R8 is a hydrocarbon-containing group containing a minimum of about 6 carbon atoms. R8 can be aliphatic or aromatic. In a preferred embodiment, R8 can be represented by the structure X2-O—X1-, wherein X1 is an alky chain of 2 or 3 carbons, and X2 is an alkyl moiety having 3 to 30 carbon atoms, more preferably an alkyl moiety having 7 to 20 carbon atoms, and where X2 can be a straight or branched, saturated or partially unsaturated hydrocarbon chain.

Examples of some mono-substituted diamines according to Formula III that may be used include phenylaminopropylamine, hexylaminopropylamine, benzylaminopropylamine, octylaminopropylamine, octylaminoethylamine, dodecylaminopropylamine, dodecylaminoethylamine, hexadecylaminopropylamine, hexadecylaminoethylamine, octadecylaminopropylamine, octadecylaminoethylamine, isopropyloxypropyl-1,3-diaminopropane, octyloxypropyl-1,3-diaminopropane, decyloxypropyl-1,3-diaminopropane, isodecyloxypropyl-1,3-diaminopropane, dodecyloxypropyl-1,3-diaminopropane, tetradecyloxypropyl-1,3-diaminopropane, isodecyloxypropyl-1,3-diaminopropane, isododecyloxypropyl-1,3-diaminopropane, isotridecyloxypropyl-1,3-diaminopropane. Mono-substituted diamines derived from fatty acids may also be used. Examples include N-coco alkyl-1,3-propanediamine (Duomeen® C), N-tallow alkyl-1,3-propanediamine (Duomeen® T), and N-oleyl-1,3-propanediamine (Duomeen® O), all obtained from Akzo Nobel.

First and second hydrocarbyl substituted amines used for the solvation of the Lindqvist ions of this invention may include a diamine of the general formula:

Formula IV

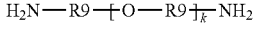

wherein k is an integer from 1 to 10. R9 is a C1 to C6 hydrocarbon-containing group where most commonly R9 contains 2 to 3 carbons. Commercial polyetheramines of this type are available from Huntsman Chemical under the trade name Jeffamine®.

First and second hydrocarbyl substituted amines used for the solvation of the Lindqvist ions of this invention may include a polyamine of the general formula:

Formula V

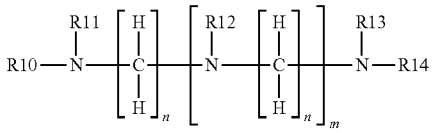

wherein R10 thru R14 may be the same or different, and each may be hydrogen, C1 to C25 straight or branched chain alkyl radicals, C1 to C12 alkoxy-(C6 alkylene) radicals, C2 to C12 alkyl amino-(C2 to C6 alkylene) radicals; each n can be the same or different ranging from 2 to 6 and preferably ranging from 2 to 3 and m is a number from 0 to 10. Examples of such compounds according to Formula V where m=0 are tetrabutoxy ethanediamine, tetrapropoxy ethanediamine, 1,4-Diazabicyclo[2.2.2]octane, 1,4-Dimethylpiperazine, N,N,N',N'-Tetramethylethylenediamine, N,N,N',N'-Tetraacetylethylenediamine, 1,1,4,7,10,10-Hexamethyltriethylenetetramine, N,N,N',N'-Tetrakis(2-hydroxyethyl)ethylenediamine, N,N,N',N'-Tetrakis(2-hydroxypropyl)ethylenediamine, ethylenediamine tetracetic acid and derivatives thereof. Examples of compounds where m is greater than 0 are diethylenetriamine, 4,7-Triazacyclononane, tris(2-aminoethyl)amine, tetraethylenepentamine, and pentaethylenehexamine.

Additionally, the sets of [R10, R11] and [R13, R14], may independently represent a cyclic structure, in particular a polyisobutylene succinimide. Examples of such polyamines are OLOA® 11000, OLOA® 11001, OLOA® 11002, (available from Chevron-Oronite), HiTEC® 644, and HiTEC® 646 (Afton Chemical).

Another class of polyamines applicable to this invention is the polyamine dispersant grafted viscosity index (VI) improvers. The patent literature is full of many examples of the preparation of such compounds. A sampling of these patents, which are hereby incorporated for reference, are U.S. Pat. Nos. 4,089,794, 4,171,273, 4,670,173, 4,517,104, 4,632,769, and 5,512,192. Typical preparation involves pre-grafting olefin copolymers with ethylenically unsaturated carboxylic acid materials to produce an acylated VI improver. The acyl groups are then reacted with polyamines to form carboxylic acid amides and succinimides.

Another class of polyamines applicable to this invention is the Mannich base dispersants. Typical Mannich bases which can be used in this invention are disclosed in U.S. Pat. Nos. 3,368,972, 3,539,663, 3,649,229, and 4,157,309. Mannich bases are typically prepared from alkylphenols having alkyl groups from 9 to 200 carbon atoms, and aldehydes, such as formaldehyde, and polyalkenylamine compounds, such triethylene tetramine, tetraethylene pentamine, and mixtures thereof.

First and second hydrocarbyl substituted amines used for the solvation of the Lindqvist ions of this invention may be a triazole of the general formula:

Formula VI

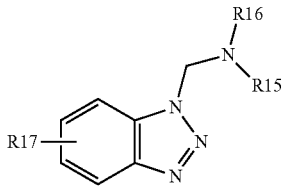

R15 and R16 may be the same or different and may represent hydrogen, C1 to C20 alkyl, C3 to C20 alkenyl, C5 to C12 cycloalkyl, or C7 to C15 arylalkyl. R17 is a hydrogen or a C1 to C20 residue, preferably R18 may be represented by a 4- or 5-methyl radical.

First and second hydrocarbyl substituted amines used for the solvation of the Lindqvist ions of this invention may be an imidazoline of the general formula:

Formula VII

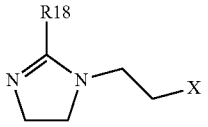

wherein X is a hydroxy or amino group and R18 is an alkyl group or fatty acid residue having 8 to 22 carbon atoms.

In one embodiment of this invention, an additive composition is prepared wherein the Lindqvist ion is combined with cationic first hydrocarbyl substituted amine.

In one embodiment of this invention, an additive composition is prepared wherein the Lindqvist ion is combined with cationic first hydrocarbyl substituted amines used for the solvation of the Lindqvist ion, and the composition further comprising a substantially inert diluent. The diluent may be mineral oils, synthetic oils, such as dicarboxylic acid esters, polyols, or alkylated benzenes. The diluent may be present in the amount of 0% to 99% by weight of the additive.

In another embodiment, the Lindqvist ion is combined with cationic first hydrocarbyl substituted amines used for the solvation of the Lindqvist ion, and the additive composition further comprising one or more second hydrocarbyl substituted amines, which may be the same or different than the first amine. The second amines of the additive composition act to solvate the Lindqvist ion in the final lubricating composition more efficiently than if the Lindqvist ion was added to a lubricating composition already comprising the second amines.

In another embodiment, the Lindqvist ion is combined with cationic first hydrocarbyl substituted amines, and the composition further comprising one or more second hydrocarbyl substituted amines, and the composition further comprising a substantially inert diluent. The diluent may be mineral oils, synthetic oils, such as dicarboxylic acid esters, polyols, or alkylated benzenes. The diluent may be present in the amount of 0% to 99% by weight of the additive.

To impart a positive effect on the lubrication properties of a hydrocarbon lubricant, the additive comprising the Lindqvist ion is added to the hydrocarbon lubricant base in a concentration of about 0.009-0.9 moles Lindqvist ion per megagram (Mg, tonne) of lubricant. As there are six moles of metal to one mole of Lindqvist ion, by definition, this equates to about 0.054-5.4 moles of metal per tonne of lubricant. A preferred concentration within this range is about 0.2-4.1 moles metal per tonne of lubricant, preferably about 1.5-2.5.

Lubricating bases to be used in the present invention include base oils for lubricating oils, which are composed of natural oils, synthetic oils or mixtures thereof, and base greases in which a thickener is compounded in any of the base oils. Natural oils include animal oils and plant oils (e.g. lard oil, castor oil, canola oil, and coconut oil), liquid petroleum oils and hydrorefined, solvent-treated or acid-treated mineral lubricating oils of the paraffinic, naphthenic and mixed paraffinic-naphthenic types. Oils of lubricating viscosity may also be defined as those derived from shale or coal. Synthetic lubricating oils used in this invention include one of any number of commonly used synthetic hydrocarbon oils, which include, but are not limited to, poly-alpha-olefins, alkylated aromatics, esters of dicarboxylic acids, silicon-based oils, alkylene oxide polymers, interpolymers, and copolymers and derivatives. Such copolymers and derivatives include compositions wherein terminal hydroxyl groups have been modified by esterification, etherification etc.

The lubricating base may contain additives in addition to the Lindqvist ion of this invention, such as those found in Lubricant Additives: Chemistry and Applications [Rudnick, 2009], which is included herein by reference.

For example, additives which may be included in the lubricant composition of this invention include additives for deposit control such as antioxidants. Examples of antioxidants are sulfurized compounds such as sulfurized olefin, sulfurized esters, and dihydrobenzothiophenes; sulfur and nitrogen based compounds such as ashless dithiocarbamates, including methylene bis(dialkyldithiocarbamates) and dithiocarbamate esters, metal dithiocarbamates including zinc, copper, lead, antimony, bismuth, tungsten and molybdenum dithiocarbamates. Antioxidants may include sulfur and phosphorus based compounds such as metal dithiophosphates including zinc, copper, lead, antimony, bismuth, tungsten and molybdenum dithiophosphates. Antioxidants may include amine and phenol derivatives such as alkylated diphenylamines, hindered phenols, and hindered amines such as those described in U.S. Pat. No. 8,093,190 and included herein by reference. Amine and phenol derived antioxidants may also include sulfur bridged phenols, and amine and phenol bearing compounds. Antioxidants may include the organic acid salts, amine salts, oxygenates, phenates and sulfonates of titanium, molybdenum, tungsten, zirconium, and manganese. Antioxidants may also include boron containing compounds such as hydroxyalkylborates, including boron epoxides, especially 1,2-epoxyhexadecane, borated alcohols including diols and polyols, hindered phenyl borates and borate esters of substituted glycerols and ethanolamides.

Additives which may be included in the lubricant composition of this invention include additives for deposit control such as detergents. Detergents include metal sulfonates, metal phenates, and metal carboxylates. The detergents may also be non-conventional materials such as those described in U.S. Pat. No. 5,556,569. The detergents may contain a stoichiometric amount a metal to alkylate, commonly referred to as a neutral detergent, or it may contain an excess of metalate and be described as basic, overbased or superbased, depending on the degree of excess metalate.

Additives which may be included in the lubricant composition of this invention include additives for deposit control such as dispersants. Dispersants include but are not limited to bis and mono-substituted polyisobutylenes, polyalphaolefins, polypropylene succinimides and mixtures thereof. Dispersants may include polymeric dispersants commonly referred to as dispersant viscosity index improvers. Dispersants may be sulfurized or non-sulfurized. They may be ashless, or may contain additional elements such as boron, molybdenum, tungsten, magnesium or copper.

Additives which may be included in the lubricant composition of this invention include ashless phosphorus compounds. Examples of which are trialkyl phosphates, triaryl phosphates, alkyl monoacid phosphates, aryl diacid phosphates, trialkyl phosphites, triaryl phosphites, dialkyl phosphites, dialkyl alkyl phosphonates, amine phosphates, and alkyl dialkyl phosphinates.

Additives which may be included in the lubricant composition of this invention include additives for film forming. These include solid particles or nanoparticles of boron nitride, $MoS_2$, $WS_2$, graphite, graphene or polytetrafluoroethylene (PTFE).

Additives which may be included in the lubricant composition of this invention include additives for film forming. These include organic friction modifiers such as carboxylic acids or their derivatives, including, but not limited to, derivatives of glycerol such as glycerol monooleate, glycerol dioleate, and glycerol monostearate. Organic friction modifiers include amides, imides, amines, and their derivatives, for example, oleylamide, alkyldiethanolaminde, and mono- and di- and tri-ethanolamide derivatives of seed oils. Also includes are organic polymers such as polymethacrylates.

Additives which may be included in the lubricant composition of this invention include organometalic additives for film forming or antiwear. These include dithiophosphates, dithiocarbamates, dithiolates, carboxylates, alkoxides, and esters of Ti, Cu, Zn, Mo, and W.

Additives which may be included in the lubricant composition of this invention include additives for antiwear and extreme pressure. These additives include sulfurized compounds such as sulfurized olefins including di-tert-nonyl and di-dodecyl trisulfides and penta-sulfides, sulfurized esters and sulfurized seed oils.

Additional antiwear and extreme pressure compounds useful as additives in the lubricant composition of this invention are ashless phosphorus compounds such as trialkyl phosphates, triaryl phosphates, alkyl monoacid phosphates, aryl diacid phosphates, trialkyl phosphites, triaryl phosphites, dialkyl phosphites, dialkyl alkyl phosphonates, amine phosphates, alkyl dialkyl phosphinates, and ashless phosphorothioates and thiophosphates Additional antiwear and extreme pressure compounds useful as additives in the lubricant composition of this invention include sulfur and nitrogen containing compounds such as 2,5-dimercapto-1,3,4-thiadiazole (DMTD), 2-mercapto-1,3-benzothiazole (MBT), and derivatives thereof. Other additives include derivatives of phenothiazines, thionoimidazolidines, thioureas, thiadiazolidines, oxadiazoles, thiuram monosulfides, thiuram disulfides, and benzoxazoles.

Additives which may be included in the lubricant composition of this invention include additives for viscosity modification. These include oil-soluble copolymers comprising ethylene and propylene, which may also contain nonconjugated dienes. These copolymers are commonly referred to as olefin copolymer (OCP) viscosity modifiers. These further include various modified OCP's such as dispersant OCPs (DOCPs), dispersant antioxidant OCPs (DAOCPs), and grafted OCPs (gOCPs). Grafted OCPs may further include the grafting of nitrogen containing compounds onto the OCP. Preferred examples of nitrogen compounds grafted onto the OCP's are vinyl pyridines, vinylpyrrolidinones, and vinylimidazoles, and phenothiazines. Furthermore, gOCPs may include the grafting of poly(alkylmethacrylate) (PMA) monomers and oligomers onto the OCP. Furthermore gOCPs may include the grafting of anhydrides or acyl groups onto the OCP. A most common functionality of this class is the grafting of maleic anhydride. This grafted OCP is then further condensed with amines, alcohols, or mixtures thereof, to form imides, amides, or esters. Furthermore, gOCPs may include the grafting of sulfur containing compounds onto the OCP; a non-limiting example of which is 2-mercapto-1,3,4-thiadiazole.

Additives which may be included in the lubricant composition of this invention include additives for viscosity modification and or pour point depression. These include polyalkylmethacrylate polymers (PMAs). These further include dispersant modified PMAs, antioxidant modified PMAs, PMA-OCP blends, and comb polymers containing both PMA and OCP components.

Additional additives which may be included in the lubricant composition of this invention for pour point depression include but are not limited to, ethylene/vinyl acetates, acrylates, alkylated styrenes, alpha olefins, methacrylates, olefin/maleic anhydrides, styrenelacrylates, styrene/maleic anhydrides, and vinyl acetate/fumarates.

Additives which may be included in the lubricant composition of this invention include tackifiers such as polyisobutylenes, ethylene-propylene copolymers or combinations thereof.

Additives which may be included in the lubricant composition of this invention include rust inhibitors such as alky amines and salts thereof, amine carboxylate salts, amine borate salts, chromates, carboxylates, hydrazines, oxidates, nitrites, silicates, sulfonates, and phosphates such as, but not limited to triaryl phosphates, alkyl-aryl phosphates, and trialkyl phosphates. Additional additives within the class of rust inhibitors are cyclic nitrogen compounds such as imidazolines, imidazoles, thiazoles, triazoles, bensotriazoles, tolutriazoles, pyridine, quinolones and morpholines.

Additives which may be included in the lubricant composition of this invention include antifoaming agents such as polysilicones and polyethyleneglycol esters.

In fully formulated lubricants, the above mentioned additives are commonly combined as an additive package, herein designated as AP, conventionally referred to as a dispersant/inhibitor package, or DI package.

It would be understood by one skilled in the art, that the above mentioned additives may be added to the lubricant composition for purposes other than those specified above, or may be combined into a lubricant formulation as part of an additive package. These include conventional additive packages, such as dispersant/inhibitor packages. Non-limiting examples of useful additive packages may be found in U.S. Pat. Nos. 5,204,012, 6,034,040, 6,645,920, 7,786,060, 8,022.024, and 8,278,254.

In one embodiment of this invention, the Lindqvist ion is added to a lubricant composition substantially devoid of phosphorus (i.e. having less than 0.01% phosphorus) in a concentration of about 1.5-2.5 moles of metal to tonne of lubricant.

In one embodiment of this invention, the Lindqvist ion is added to a lubricant composition containing a phosphorus source wherein the molar ratio of phosphorus to metal from the Lindqvist ion is in the range of about 3-100.

In one embodiment of this invention, the Lindqvist ion is added to a lubricant composition containing a zinc source wherein the molar ratio of zinc to metal from the Lindqvist ion is in the range of about 1.5-52.

The following examples are given for the purpose of exemplifying aspects of the embodiments of this invention and are not intended to limit the embodiments in any way.

EXAMPLES

Lindqvist ions were prepared according to literature methods described above. It will be apparent to one skilled in the art that Lindqvist ions may be derived from a multitude of pathways, and methods may be employed to prepare Lindqvist ions other than those described herein. Methods of preparing Lindqvist ions are not within the scope of this invention.

Lubricant additive compositions were prepared containing exemplary Lindqvist ions of this invention wherein the additive composition further contains amine compounds to increase the hydrocarbon solubility of the Lindqvist ions. There is no particular restriction on the amine compound used to solvate the constituting the Lindqvist ions. For these specific examples, the Lindqvist ion was rendered soluble in the lubricating base using trioctylamine (Aldrich Chemical) or ditridecylamine (DTDA); specifically, ditridecylamine—mixture of isomers, available from Nova Molecular Industries Inc., and ($C_{11}$-$C_{14}$, branched and linear alkyl) amines, available from BASF corporation as taught for non-Lindqvist ion of molybdenum and tungsten in U.S. Pat. Nos. 3,282,838, 8,071,518 and European Pat. No. 0755938. In several instances, a hydrocarbon diluent was also added to reduce the viscosity of the lubricant additive composition.

The lubricant additive compositions were then added to lubricating compositions comprising a base oil in amounts sufficient to provide 0.2-3 moles of metal, per tonne of lubricant. For lubricant compositions which also comprise a phosphorus source, the ratio of phosphorus to metal from the Lindqvist ions ranged from 8:1 to 108:1 molar.

Samples were tested in a Falex Pin & Vee Block Testing apparatus. The Falex Pin & Vee Block Test evaluates the extreme pressure properties or wear characteristics of a lubricant. The machine rotates a test pin against two stationery Vee Blocks at 290 rpm under a constant 500 lbs. load for sixty minutes while being immersed in the test lubricant. Wear loss is measured as milligrams of wear by differential weight before and after the test. The lubricant is generally considered to fail the test if the test pin breaks before completion of the 60 minutes.

Wear properties were also measured using a Four Ball Wear testing apparatus. The Four Ball Wear testing apparatus uses four balls arranged in an equilateral tetrahedron. The lower three balls are clamped securely in a test cup filled with lubricant and the upper ball is held by a chuck which is motor driven, causing the upper ball to rotate against the fixed lower balls. Load is applied in an upward direction through a weight/lever arm system. Heaters allow operation at elevated oil temperatures. At the end of a run, the diameter of the scars on the three stationary balls are measured and averaged. The relative scar diameters from different test lubricants provides a relative measure of anti-wear properties. Tests were run at 1800 rpm for 1 hour at 54° C. under a load of 20 kgf.

Lubricant composition examples were tested for antioxidancy at 180° C. using Pressurized Differential Scanning calorimetry (ASTM D 5483). The test measures oxidation induction time (OIT). Longer OIT can be used as an indication of increased oxidation stability.

Example 1

The Lindqvist polyoxometalate, tetrahydrogen-$\mu_6$-oxo-dodeca-$\mu$-oxo-hexaoxo(tetratungsten divanadium)ate ($H_4[V_2W_4O_{19}]$) was prepared according to literature methods [Domaille, JACS, 1984]. It was then neutralized with four equivalents of trioctylamine; yielding a Lindqvist ion salt. To this, an additional 4 molar equivalents of ditridecylamine was added as a solvating agent; giving a final nitrogen to Lindqvist ion molar ratio of 8:1. The mixture was then diluted with process oil to give a lubricant additive composition containing 13.9% Lindqvist ion, 1.24% V and 9.04% W by weight.

Example 2

The Lindqvist polyoxometalate, tetrahydrogen-$\mu_6$-oxo-dodeca-$\mu$-oxo-hexaoxo(tetratungsten divanadium)ate ($H_4[V_2W_4O_{19}]$) was prepared according to literature methods

[Flynn, Inorg. Chem., 1973]. It was then neutralized with four equivalents of ditridecylamine to form a Lindqvist ion salt; giving a final nitrogen to Lindqvist ion molar ratio of 4:1. The resinous salt was further diluted to 36.3% by weight with process oil to give a lubricant additive composition containing 15.8% Lindqvist ion, 1.4% V and 10.2% W by weight.

Example 3

The Lindqvist polyoxometalate, dihydrogen-$\mu_6$-oxo-dodeca-μ-oxo-hexaoxo-hexatungstate ($H_2[W_6O_{19}]$) was prepared according to literature methods [Fuchs, Acta Crystallogr. B, 1978]. It was then neutralized with two equivalents of ditridecylamine to form a Lindqvist ion salt. To this, an addition four molar equivalents of DTDA was added as a solvating agent. The final nitrogen to Linqvist ion molar ratio was 6:1. To reduce viscosity, the mixture was then further diluted with a mineral oil base stock to give a composition of 19% Lindqvist ion by weight, 821 mole of metal per tonne of lubricant additive composition, and a viscosity of 14 cPs at 25° C.

Example 4

The Lindqvist polyoxometalate, dihydrogen-$\mu_6$-oxo-dodeca-μ-oxo-hexaoxo(molybdenum pentatungsten)ate was prepared by suspending 0.25 moles of $MoO_3$ in 6.00 moles of water and holding at reflux for 3 hours. Then 0.25 moles of ditridecylamine was added, followed by 132.6 g of process oil, and holding at 100° C. for 2.5 hours. To this mixture, 2.5 ml of a 6N sulfuric acid solution was added, and the reaction stirred at 100° C. for 35 minutes. It was then allowed to cool and the aqueous phase and residual solids removed. The resulting solution contained 8.8% Mo, by weight. The polymolybdate product was then reacted with the product of Example 3 in a 5:1 molar ratio of W:Mo. The mixture was heated to 120° C. for 15 minutes, then at 100° C. for 5 hours under vacuum. The resulting lubricant additive composition had a nitrogen to Lindqvist ion molar ratio of 6:1, and contained 17.6% Lindqvist ion by weight, and 802 mole of metal per tonne of lubricant additive composition.

Example 5

The Lindqvist polyoxometalate, isopropyloxy-$\mu_6$-oxo-dodeca-μ-oxo-pentaoxo(titanium pentatungsten)ate was prepared according to literature methods by reacting the composition of Example 3 with titanium isopropoxide in a 5:6 molar ratio. [Errington, Dalton Trans. 2007; Wei, Inorganic Chemistry, 2001]. The resulting composition contained 20.2% mixed metalate Lindqvist ion by weight, a nitrogen Lindqvist ion molar ratio of 5:1, and 923 mole of metal per tonne of lubricant additive composition.

Example 6

The Lindqvist polyoxometalate, dihydrogen-(2-methyl-1-propoxy)-$\mu_6$-oxo-dodeca-μ-oxo-pentaoxo(pentatungsten zirconium)ate was prepared according to literature methods [Villanneau, J. Phys. Chem. B, 2004]. It was then combined with ditridecylamine in a single step which both neutralized the Lindqvist anion and added additional solvating amine. The resulting nitrogen to Lindqvist ion molar ratio was 6:1. In this Lindqvist ion preparation, an oxygen at a vertex of the Lindqvist octahedron is substituted with a 2-methyl-1-propoxy group. The mixture was further diluted with a mineral oil base stock to give a composition of 20.1% Lindqvist ion by weight, and 881 mole of metal per tonne of lubricant additive composition.

Example 7

The Lindqvist polyoxometalate, $\mu_6$-oxo-dodeca-μ-oxo-pentaoxo(tantalum pentatungsten)ate was prepared according to literature methods by reacting the composition of Example 3 with tantalum(V) ethoxide in a 5:6 molar ratio. [Besecker, Inorganic Chemistry, 1985]. The resulting composition contained 22.3% mixed metalate Lindqvist ion by weight, a nitrogen to Lindqvist ion ratio of 5:1, and 952 moles of metal per tonne of lubricant additive composition.

Example 8

The Lindqvist polyoxometalate, trihydrogen-$\mu_6$-oxo-dodeca-μ-oxo-hexaoxo(niobium tungsten)ate was prepared according to literature methods [F. Bannani, J. Chem. Crystallogr. 2007]. It was then combined with ditridecylamine to neutralized the Lindqvist anion, yielding a complex of pH=4.7. In a separate step, additional ditridecylamine was added which reduced the viscosity of the lubricant additive and raised the pH to 5.7. The resulting nitrogen to Lindqvist ion molar ratio was 6:1. The lubricant additive composition contained 40.8% Lindqvist ion by weight, and 1659 mole of metal per tonne of lubricant additive composition.

Example 9

A lubricating composition was prepared using a naphthenic base stock designated as Unithene 100 naphthenic oil, commercially available from Ergon, Inc. of Jackson, Miss. To this base oil of lubricating viscosity, lubricant additive compositions containing exemplary Lindqvist ions of this invention were added according to Table 1. The resulting lubricant compositions contained metal, as supplied by the Lindqvist ions, at concentrations of 1.9-2.2 moles of metal per tonne of lubricant. The percentages shown indicate weight percentage.

TABLE 1

| Ex. | Description | Example 9.1 | Example 9.2 | Example 9.4 | Example 9.5 | Example 9.3 | Example 9.6 |
|---|---|---|---|---|---|---|---|
| | Naphthenic Base Oil | 100 | 99.77 | 99.74 | 99.76 | 99.76 | 99.80 |
| 3 | $[W_6O_{19}]^{2-}$ | — | 0.23 | — | — | — | — |
| 4 | $[MoW_5O_{19}]^{2-}$ | — | — | 0.26 | — | — | — |
| 5 | $[(C_3H_7O)TiW_5O_{18}]^{3-}$ | — | — | — | 0.24 | — | — |
| 6 | $[(C_4H_{10}O]ZrW_5O_{18}]^{2-}$ | — | — | — | — | 0.24 | — |
| 7 | $[TaW_5O_{19}]^{3-}$ | — | — | — | — | — | 0.20 |

TABLE 1-continued

| Ex. | Description | Example 9.1 | Example 9.2 | Example 9.4 | Example 9.5 | Example 9.3 | Example 9.6 |
|---|---|---|---|---|---|---|---|
| | Moles of Metal/Mg of Lubricant | — | 1.90 | 2.10 | 2.18 | 2.08 | 1.91 |
| | Falex Pin & Vee Block 500 lb, 60 min Mass Loss (mg) | FAIL | 25.8 | 16.1 | 10.5 | 1007.1 | 45.5 |
| | Falex time | <1 | 60 | 60 | 60 | 33 | 60 |
| | 4-Ball wear 1800 rpm; 54° C.; 1 hr@20 kgf | 0.75 | 0.47 | 0.42 | 0.47 | 0.38 | 0.42 |

Examples 9.2-9.6 show improved performance over comparative example 9.1 in either the Falex Pin and Vee test, the Four Ball Wear Test, or both, illustrating the effectiveness of the Lindqvist ions as antiwear additives.

Example 10

A lubricating composition was prepared using a naphthenic base stock designated as Unithene naphthenic oil, commercially available from Ergon, Inc. of Jackson, Miss. The base stock was combined with 1.5% by weight alkylated diphenylamine antioxidant (ADPA), designated as VANLUBE 961, commercially available from Vanderbilt Chemicals, LLC of Norwalk, Conn. In general, the alkylated diphenylamine may be present from about 0.1-5% by weight. The lubricating composition also contained a zinc dialkyldithiophosphate (ZDDP) designated as OLOA 262, available from Chevron Oronite Company LLC, which provided 6.4-6.6 moles of phosphorus per tonne of lubricant. In general, ZDDP may be present in an amount to provide about 0.323-32.3 moles of phosphorus per tonne (megagram) of lubricant. To this base formulation, lubricant additive compositions containing exemplary Lindqvist ions of this invention were added according to Table 2. The final lubricant compositions contained metal, as supplied by the Lindqvist ions, at concentrations of 1.9-2.5 moles of metal per tonne of lubricant. Wear properties were measured using Falex Pin and Vee and Four Ball Wear test methods.

Table 2 illustrates that compositions containing a phosphorus source and Lindqvist ions of this invention have superior wear properties over comparative example 10.1, which comprises a phosphorus source, but is devoid of the Lindqvist ions of this invention. Further, in comparing the compositions of Table 2 with those of Table 1, it may be observed that formulations devoid of phosphorus but comprising the Lindqvist ions of this invention provide effective anti-wear protection which is greater than the phosphorus containing composition of Example 10.1. As such, the Lindqvist ions may be used as partial or total replacements for phosphorus containing additives such as ZDDP.

Example 11

A fully formulated lubricating composition was prepared using a mixture of severely hydrotreated and hydrocracked base oils, conventionally referred to as a Group III base stock. This base also contained an additive package (AP) containing conventional amounts of olefinic copolymer viscosity index improver, polymethylmethacrylate pour point depressant, polyisobutylene succinimide dispersant, overbased calcium sulfonate detergent, ZDDP, alkylated diphenylamine antioxidant and phenolic antioxidant. The additive package provided 16.6% by weight of the lubricant composition. To this base formulation, lubricant additive compositions containing Lindqvist ions of this invention were added according to Table 3. The final lubricant compositions contained metal, as supplied by the Lindqvist ions, at concentrations of 0.24-2.4 moles of metal per tonne of lubricant.

TABLE 2

| Ex. | Description | Example 10.1 | Example 10.2 | Example 10.3 | Example 10.4 | Example 10.5 | Example 10.6 | Example 10.7 |
|---|---|---|---|---|---|---|---|---|
| | Naphthenic Base Oil | 98.22 | 97.88 | 97.99 | 97.96 | 97.99 | 97.96 | 98.02 |
| | ADPA | 1.5 | 1.5 | 1.5 | 1.5 | 1.5 | 1.5 | 1.5 |
| | ZDDP | 0.28 | 0.28 | 0.28 | 0.28 | 0.28 | 0.28 | 0.28 |
| 1 | $[V_2W_4O_{19}]^{4-}$ | — | 0.34 | — | — | — | — | — |
| 3 | $[W_6O_{19}]^{2-}$ | — | — | 0.23 | — | — | — | — |
| 4 | $[MoW_5O_{19}]^{2-}$ | — | — | — | 0.26 | — | — | — |
| 5 | $[(C_3H_7O)TiW_5O_{18}]^{3-}$ | — | — | — | — | 0.23 | — | — |
| 6 | $[(C_4H_{10}O]ZrW_5O_{18}]^{2-}$ | — | — | — | — | — | 0.26 | — |
| 7 | $[TaW_5O_{19}]^{3-}$ | — | — | — | — | — | — | 0.2 |
| | Moles of Metal/Mg of Lubricant | | 2.5 | 1.9 | 2.1 | 2.18 | 2.08 | 1.91 |
| | ppm P | 200 | 200 | 200 | 200 | 200 | 200 | 200 |
| | Falex Pin & Vee Block 500 lb, 60 min Mass Loss (mg) | FAIL | 7.3 | 20 | 32.8 | 30.7 | 54.2 | 16 |
| | Falex time | 23 | 60 | 60 | 60 | 60 | 60 | 60 |
| | 4-Ball wear 1800 rpm; 54° C.; 1 hr@20 kgf | 0.52 | 0.52 | 0.53 | 0.59 | 0.57 | 0.51 | 0.57 |

TABLE 3

| Ex. | Example No. | 11.1 | 11.2 | 11.3 | 11.4 | 11.5 | 11.6 | 11.7 | 11.8 | 11.9 |
|---|---|---|---|---|---|---|---|---|---|---|
| | Group III Oil | 83.36 | 83.32 | 82.95 | 83.33 | 83.07 | 83.33 | 83.06 | 83.33 | 83.08 |
| | Additive Package | 16.64 | 16.64 | 16.64 | 16.64 | 16.64 | 16.64 | 16.64 | 16.64 | 16.64 |
| 1 | $[V_2W_4O_{19}]^{4-}$ | | 0.04 | 0.41 | | | | | | |
| | $[V_2W_4O_{19}]^{4-}$ | | | | 0.03 | 0.29 | | | | |
| 3 | $[W_6O_{19}]^{2-}$ | | | | | | 0.03 | 0.28 | | |
| 4 | $[MoW_5O_{19}]^{2-}$ | | | | | | | | 0.03 | 0.26 |
| Moles of Metal/Mg of Lubricant | | | 0.3 | 3.02 | .024 | 2.42 | 0.24 | 2.42 | 0.22 | 2.23 |
| Moles of P/mole of metal | | | 80.27 | 8.03 | 100.08 | 10.01 | 100 | 10 | 108.47 | 10.85 |
| 4-Ball Wear 1800 rpm; 54° C.; 1 hr@20 kgf | | 0.28 | 0.32 | 0.33 | 0.3 | 0.29 | 0.27 | 0.27 | 0.36 | 0.27 |
| Oxidation Induction Time (ASTM D 5483) | | 153.2 | 178.4 | 104.7 | 164.4 | 136.4 | 153 | 172.1 | 169.6 | 266.5 |

| Ex. | Example No. | 11.10 | 11.11 | 11.12 | 11.13 | 11.14 | 11.15 | 11.16 | 11.17 |
|---|---|---|---|---|---|---|---|---|---|
| | Group III Oil | 83.33 | 83.1 | 83.33 | 83.08 | 83.33 | 83.1 | 83.34 | 83.21 |
| | Additive Package | 16.64 | 16.64 | 16.64 | 16.64 | 16.64 | 16.64 | 16.64 | 16.64 |
| 5 | $[(C_3H_7O)TiW_5O_{18}]^{3-}$ | 0.03 | 0.26 | | | | | | |
| 6 | $[(C_4H_{10}O]ZrW_5O_{18}]^{2-}$ | | | 0.03 | 0.27 | | | | |
| 7 | $[TaW_5O_{19}]^{3-}$ | | | | | 0.03 | 0.26 | | |
| 8 | $[NbW_5O_{19}]^{3-}$ | | | | | | | 0.01 | 0.15 |
| Moles of Metal/Mg of Lubricant | | 0.24 | 2.42 | 0.24 | 2.42 | 0.24 | 2.43 | 0.24 | 2.42 |
| Moles of P/mole of metal | | 99.99 | 10 | 99.98 | 10 | 99.46 | 9.97 | 100 | 10 |
| 4-Ball Wear 1800 rpm; 54° C.; 1 hr@20 kgf | | 0.29 | 0.31 | 0.31 | 0.3 | 0.31 | 0.29 | 0.29 | 0.31 |
| Oxidation Induction Time (ASTM D 5483) | | 156.1 | 151.7 | 160.8 | 174 | 154.6 | 179 | 157 | 152.4 |

As illustrated by the forgoing results, Lindqvist ions may provide improved antioxidancy to lubricating compositions as compared to similar compositions devoid of the Lindqvist ion additive.

The foregoing embodiments are susceptible to considerable variation in their practice. Thus, the embodiments are not intended to be limited to the specific exemplifications set forth within this disclosure. Rather, the foregoing embodiments are within the spirit and scope of the appended claims.

What is claimed is:

1. A lubricating composition, comprising a major amount of a base oil, and an additive comprising a polyoxo Lindqvist ion of formula $[M1_aM2_bQ1_cQ2_d]^q$, wherein M1 and M2 may be the same metal or different metal chosen from Group 3-12 transition metals, Q1 is a terminal atom or ligand, Q2 is a bridging atom selected from the group consisting of oxygen and sulfur, a+b=6 c+d=19, q represents charge, and the Lindqvist ion being solvated with a first hydrocarbyl substituted amine, the additive being present in an amount to provide about 0.2 about 3 moles of metal from the Lindqvist ion per megagram of lubricating composition.

2. The lubricating composition of claim 1, wherein M1 and M2 are the same metal chosen from a Group 4-6 transition metals.

3. The lubricating composition of claim 2, wherein M1 and M2 are each tungsten.

4. The lubricating composition of claim 2, wherein M1 and M2 are each molybdenum.

5. The lubricating composition of claim 1, wherein M1 is a different metal from M2, a<b, and M1 is chosen from Group 3-12 transition metals and M2 is chosen from Group 4-6 transition metals.

6. The lubricating composition of claim 5, wherein M2 is tungsten.

7. The lubricating composition of claim 5, wherein M2 is molybdenum.

8. The lubricating composition of claim 1, wherein the molar ratio of nitrogen from the hydrocarbyl substituted amine to the metal content in the Lindqvist ion is from 1/3:1 to 6:1.

9. The lubricating composition of claim 8, wherein the molar ratio of nitrogen from the hydrocarbyl substituted amine to the metal content in the Lindqvist ion is from 2/3:1 to 1:3/4.

10. The lubricating composition of claim 1, wherein the composition is substantially devoid of phosphorus.

11. The lubricating composition of claim 1, wherein the hydrocarbyl substituted amine is ditridecylamine.

12. The lubricating composition of claim 1, wherein the hydrocarbyl substituted amine is trioctylamine.

13. The lubricating composition of claim 1, wherein the Lindqvist ion is chosen from the group consisting of: $[V_2W_4O_{19}]^{4-}$; $[W_6O_{19}]^{2-}$; $[MoW_5O_{19}]^{2-}$; $[[C_3H_7O]TiW_5O_{18}]^{3-}$; $[[C_4H_{10}O]ZrW_5O_{18}]^{2-}$; $[TaW_5O_{19}]^{3}$ and $[NbW_5O_{19}]^{3-}$.

14. The lubricating composition of claim 1, wherein the Lindqvist ion contains bound organic ligands containing electron donating groups.

15. The lubricating composition of claim 1, further comprising an alkylated diphenylamine and zinc dithiophosphate.

16. The lubricating composition of claim 1, wherein the hydrocarbyl substituted amine is ($C_{11}$-$C_{14}$, branched and linear alkyl) amine.

17. The lubricating composition of claim 1, wherein Q1 is an organic ligand containing electron donating groups comprising B, C, N, O, P or S, wherein the ligand is bound to the Lindqvist ion through said electron donating groups.

* * * * *